United States Patent [19]

Bakken

[11] Patent Number: 4,640,170

[45] Date of Patent: Feb. 3, 1987

[54] CHAIN SAW CARRIAGE

[76] Inventor: John A. Bakken, 8837 S. Barnards Rd., Canby, Oreg. 97013

[21] Appl. No.: 706,526

[22] Filed: Feb. 28, 1985

[51] Int. Cl.[4] ..... B27B 17/00

[52] U.S. Cl. ..... 83/794; 83/795; 83/574; 83/404.1; 30/371

[58] Field of Search ..... 83/794, 795, 574, 404.1; 30/371

[56] References Cited

U.S. PATENT DOCUMENTS

| | | | |
|---|---|---|---|
| 1,861,162 | 5/1932 | Quist | 30/371 |
| 2,779,359 | 1/1957 | Koski | 30/371 |
| 2,800,932 | 7/1957 | Scott | 83/404.1 |
| 3,115,909 | 12/1963 | McManama . | |
| 3,225,799 | 12/1965 | Hayden et al. . | |
| 4,070,757 | 1/1978 | Granberg et al. . | |
| 4,122,604 | 10/1978 | Brown . | |
| 4,244,104 | 1/1981 | Grube . | |
| 4,332,084 | 6/1982 | Lovas et al. . | |

FOREIGN PATENT DOCUMENTS

| | | | |
|---|---|---|---|
| 847653 | 8/1952 | Fed. Rep. of Germany | 83/795 |
| 359277 | 2/1962 | Switzerland | 83/794 |
| 2118481 | 11/1983 | United Kingdom | 83/795 |

OTHER PUBLICATIONS

Granberg Industries Catalog, "Greater Use and Value From Your Chain Saw", pp. 12–13.

Granberg Industries Catalog Excerpt, "Granberg Chain Saw Equipment", pp. 11–12, 14–15.

Granberg Industries Catalog, "More Money From Your Chainsaw", (8 pages).

*Primary Examiner*—Donald R. Schran

*Attorney, Agent, or Firm*—Klarquist, Sparkman, Campbell, Leigh & Whinston

[57] ABSTRACT

A chain saw attachment for mounting a chain saw used to cut reclined logs lengthwise includes a substantially right parallelepiped frame which straddles but does not contact the log. The frame is supported by a supporting surface independent of the log and cooperates with mounting means for rigidly mounting the chain saw in a cutting position. The frame is mounted on feet which permit the frame to be slid along the supporting surface, typically the ground. The mounting means includes two sets of clamping members for gripping opposite ends of a saw bar of the chain saw. Each set is supported by a vertical chain saw support member that is vertically adjustable to vary the level of the chain saw's cutting plane relative to the log. Each chain saw support member mounts a nut that is engaged by a threaded rod, rotation of which causes the chain saw support member and hence gripped chain saw to move vertically. Both threaded rods mount respective sprockets which are interconnected by a drive chain. Rotation of one threaded rod causes simultaneous corresponding rotation of the other threaded rod to permit level height adjustment of the entire chain saw.

4 Claims, 6 Drawing Figures

CHAIN SAW CARRIAGE

FIELD OF THE INVENTION

The present invention relates to sawing apparatus and more particularly to portable chain saw attachments for cutting felled logs lengthwise.

BACKGROUND OF THE INVENTION

It is sometimes desirable to process felled logs into lumber on site, thereby eliminating the need to transport the logs from the site to a sawmill and hence reducing fuel and labor costs. It is particularly desirable to do so if the logs are felled at a remote location and the lumber produced from such logs is to be used on site. Prior portable chain saw attachments designed to meet this need, sometimes referred to as "chain saw mills", have not proved entirely satisfactory.

Three similar chain saw attachments or mills are disclosed in Grube U.S. Pat. No. 4,244,104; Granberg et al. U.S. Pat. No. 4,070,757; and Hayden et al. U.S. Pat. No. 3,225,799. These patents each disclose a chain saw attachment having a frame or carriage attachable to the saw bar of the chain saw. Each attachment has parallel transverse frame elements supported by the log's upper surface. Such frame elements slide along the log's upper surface as the chain saw is fed lengthwise through the log to cut away a slab or section of preset thickness. These attachments operate on the premise that the transverse frame elements are supported on a perfectly flat, typically horizontal upper surface formed from a prior cut, except for a preliminary cut by which a portion of the log's rounded, outermost edge (sometimes referred to as "outer slab") is removed. Each preliminary cut is made by first nailing a board to the log's rounded outer surface to provide a flat, horizontal guide reference for the attachment. The log is then cut as just described, except that the frame elements are supported by the board instead of the log's upper surface.

The foregoing set-up procedure required for each outer slab cut is time-consuming, particularly since the board must be removed from the outer slab once the cut is completed. In addition, the foregoing attachments rely on the previous cut as a reference for the next cut and hence any inaccuracies, such as undulations, in a prior cut not only affect but can be compounded in later cuts. Further, at least a portion if not all the weight of the chain saw and attachment is exerted on the section or slab being cut, thereby causing an increased pinching force to be exerted on the saw chain during cutting and hence increased risk of chain binding, unless time-consuming precautions are taken. Also, such attachments are physically limited in their ability to process small diameter logs approaching six inches in diameter. Finally, the foregoing attachments are all relatively wide to accommodate large chain saws, making them unwieldy and bulky when used with smaller chain saws.

Other more complicated, heavier and therefore less portable "on site" log sawing devices are disclosed in Lovas et al. U.S. Pat. No. 4,332,084; Brown U.S. Pat. No. 4,122,604; and McManama U.S. Pat. No. 3,115,909. These devices have at least one feature in common with the foregoing chain saw attachments, namely, the use of the log's upper surface as a reference to support and guide the device during cutting. Thus, they have the same binding and, except for Lovas et al., inaccurate cutting, and preliminary set-up problems as the foregoing chain saw attachments. Also, they are even more limited in their capacity to cut small logs than the foregoing attachments.

The Lovas et al. apparatus uses a band mill instead of a chain saw. It is large and heavy and apparently requires more than one person to operate and handle it. It self-corrects for undulations in prior cuts to some degree but not altogether by supporting the apparatus on resilient rubber rollers in contact with the top of the log. The rollers average the vertical displacement of the frame over a greater distance and provide better weight distribution. A pendulum-type leveling means is provided as a visual guide for the operators during preliminary "outer slab" cuts, thereby eliminating the need to nail a board to the log's outer surface. However, such cuts are therefore subject to operator error, which results when the cutting plane of the saw chain is not kept perfectly horizontal.

The Brown and McManama devices also appear to be large, heavy machines which are difficult for one person to handle and operate. The McManama machine uses a band saw cutting mechanism, which is driven by an electric motor and hence requires a separate power source. The Brown machine, which appears to be specially designed to cut large logs, uses a chain saw type cutting means and includes power operated means for feeding the chain saw lengthwise through the log.

Accordingly, there is a need for an improved portable chain saw attachment that is simple, effective, accurate, efficient, capable of cutting small diameter logs and suitable for use by one person.

SUMMARY OF THE INVENTION

The present invention is a new chain saw attachment to facilitate cutting a reclined log lengthwise into lumber. It includes a frame and mounting means for mounting a chain saw to the frame. The frame is adapted to be supported by a substantially flat frame supporting portion independent of the log when the chain saw is in cutting engagement with the log. In a preferred embodiment, the invention is provided with sliding means to support the frame in sliding contact with the frame supporting surface. It also includes width adjusting means for varying the effective width of the frame. Height adjusting means are provided to adjust the vertical position of the mounting means and hence the supported chain saw relative to the frame supporting surface. The mounting means includes a first clamping means for clamping a nose end of the chain saw and a second clamping means for clamping the chain saw proximate its motor end.

It is therefore one object of the present invention to provide an improved chain saw attachment that is simple, effective, accurate, efficient and suitable for use by one person.

Another object of the invention is to provide a chain saw attachment that eliminates or at least minimizes the effect of any prior cutting inaccuracies on subsequent cuts.

A further object of the invention is to provide an attachment which reduces set-up time for preliminary outer slab cuts.

Still another object of the present invention is to provide an attachment which reduces the possibility of saw chain binding.

A further object of the present invention is to provide an attachment which is compact and easy to use with relatively small chain saws, yet suitable for use with larger chain saws as well.

Yet another object of the present invention is to provide an attachment which accurately adjusts the height of both ends of the chain saw to facilitate level cutting of the log.

Another object of the present invention is to provide an attachment that is capable of cutting boards having a thickness as small as about ¼ inch.

A further object of the present invention is to provide an attachment capable of making beveled cuts.

Still another object of the present invention is to provide an attachment that is capable of processing logs having a diameter as small as about six inches.

Other objects and advantages of the invention will become apparent from the following detailed description and with reference to the accompanying drawings.

DETAILED DESCRIPTION OF A PREFERRED EMBODIMENT

Apparatus

The present invention is a chain saw attachment which serves as a carriage to support a chain saw for cutting felled or reclined logs "L" lengthwise. The logs are supported on a flat log supporting surface, typically the ground. The chain saw is supported such that it cuts the log lengthwise along a cutting plane substantially parallel to the log supporting surface, although beveled cuts can be made by tilting the attachment such that the cutting plane is disposed angularly to the log supporting surface.

Figure 2:
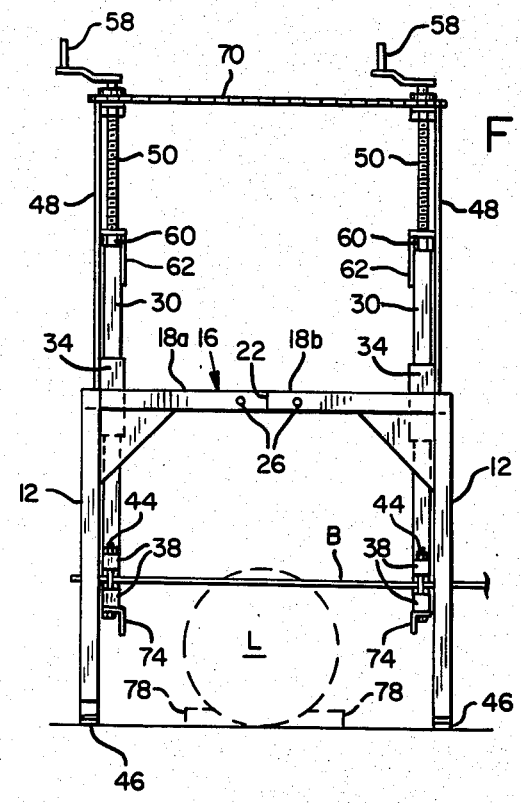
FIG. 2 is a front elevation view with only a portion of the chain saw shown.
Figure 3:
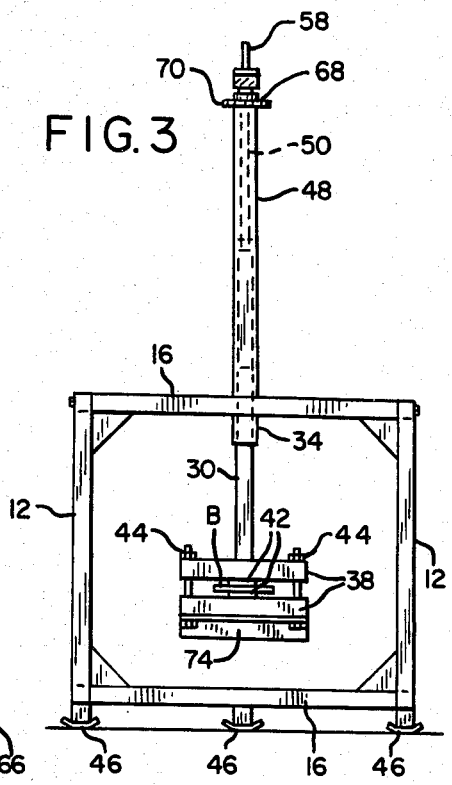
FIG. 3 is an end elevation view.
Figure 1:
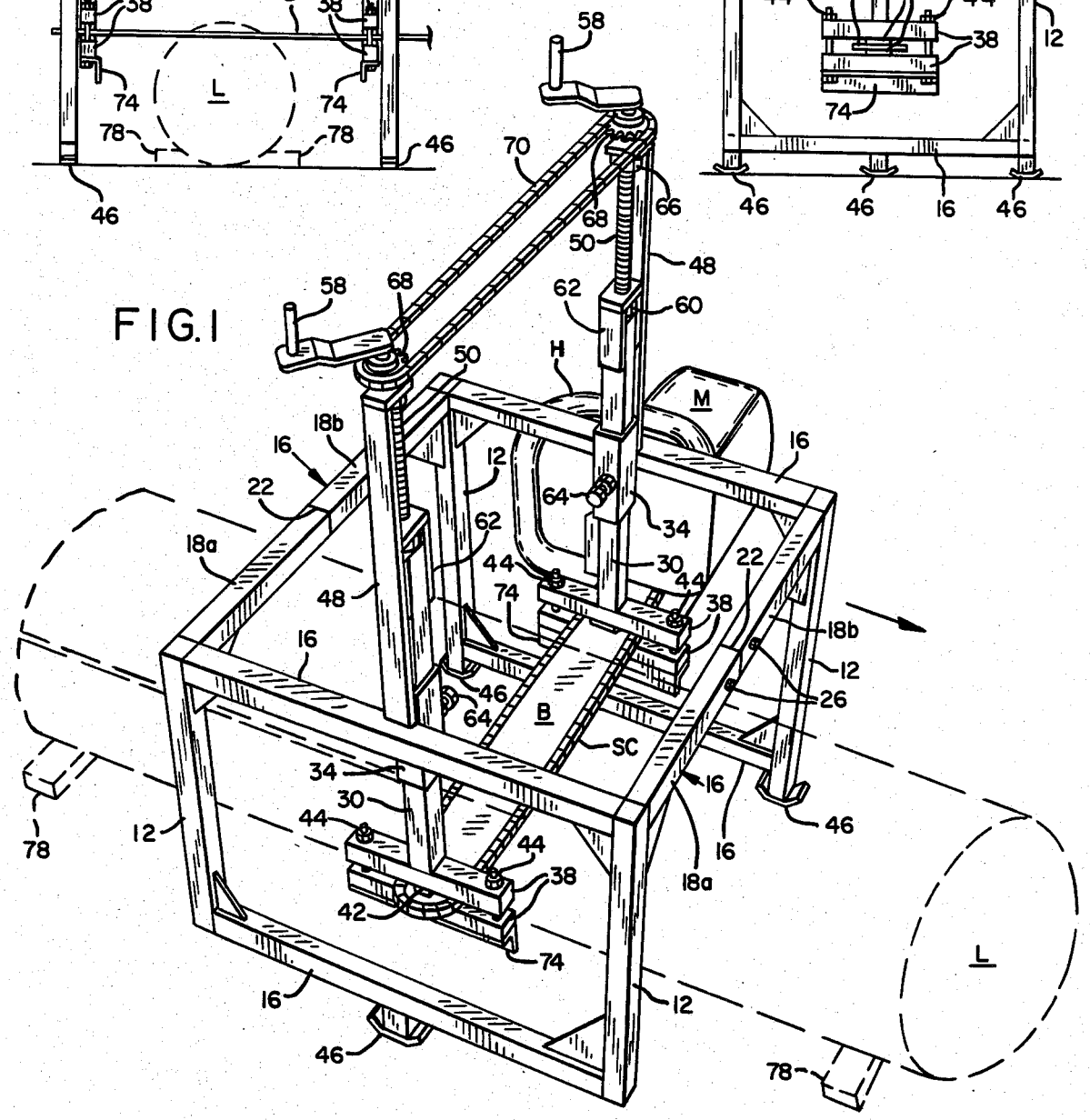
FIG. 1 is a perspective view showing a chain saw carriage in accordance with the present invention, with a chain saw mounted thereto.
Figure 4:
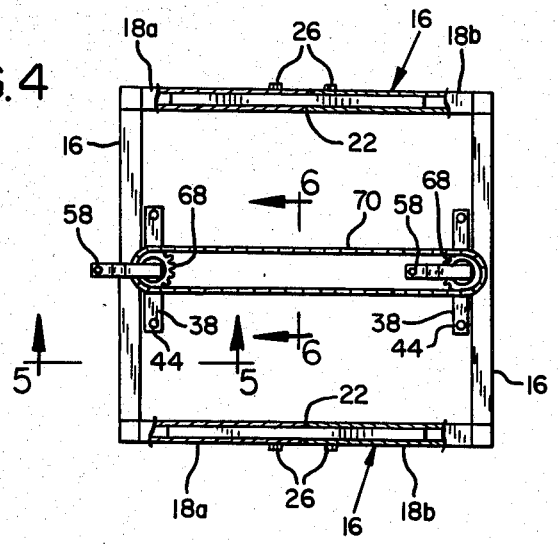
FIG. 4 is a top plan view of the invention with part of the frame portion broken away.

The supported chain saw (FIG. 1) typically has a motor "M", saw bar "B", handle "H", and saw chain "SC" driven by the motor for guided movement about the saw bar. One end of the chain saw is typically referred to as the "motor end" and the other end is typically referred to as the "nose end".

The chain saw carriage includes a rigid frame and mounting means for detachably mounting the chain saw to the frame, typically with the saw bar and hence cutting plane of the chain saw parallel to the log supporting surface. The frame straddles but does not contact the reclined log and typically is supported by the same supporting surface as the log.

The frame is supported on a sliding means to permit the carriage to slide along the ground (or other supporting surface) as the chain saw cuts longitudinally through the log. A height adjusting means permits the chain saw to be moved vertically relative to the log supporting surface so that the log can be cut lengthwise at different levels. A leveling means causes the motor end and nose end of the chain saw to move vertically the same amount when height adjustments are made.

The frame includes a plurality of vertical and horizontal support members 12, 16 rigidly interconnected at their ends, preferably by welding, substantially to form a right parallelepiped. Vertical support members or legs 12 are spaced apart and of sufficient length such that the frame is capable of straddling a felled log, with two legs 12 on each side of the log. Two pairs of opposed parallel support members 16, one pair extending longitudinally and the other transversely, are provided at the top of the frame, above the felled log. Also, a pair of opposed, parallel support members 16, extending longitudinally, are provided at the base of the frame to provide rigidity. Thus, the frame straddles the log and can be moved lengthwise of the log without interference.

Both transverse support members 16 are formed of a pair of hollow elements **18*a*, 18*b* spliced together at 22. The spliced connection serves as a width adjusting means to vary the effective width of the frame to accommodate chain saws of different sizes. Once a width adjustment is made, set screws 26 are tightened to lock elements 18*a*, 18*b* in place along the spliced connection to maintain frame rigidity. It will be apparent from FIGS. 1–4 that elements 18*a*, 18*b*** are shown in their most retracted position in which they abut one another.

The mounting means includes a first clamping means for clamping and supporting the nose end of the saw bar B and identical second clamping means for clamping and supporting a portion of the saw bar proximate the motor end of the chain saw. Shown best in FIGS. 5 and 6, each such clamping means includes a vertical chain saw support member 30 supported for vertical movement within a guide sleeve 34 welded to the frame and a pair of vertically spaced clamping bars 38 interconnected by bolts 44 or other suitable fastening means. The uppermost clamping bar is preferably welded to the chain saw support member, which is conveniently fabricated from square tube like support members 12, 16. Both clamping bars have respective spacer elements 42 which cooperate with one another to grip the saw bar of the chain saw therebetween. Spacer elements 42 are narrower than the width of the saw bar and sized to keep the clamping bars spaced apart enough to permit the saw chain to move about the saw bar unimpeded.

For maximum balance, it is desirable for the first clamping means to grip the saw bar near its nose end and the second clamping means to grip the saw bar near the motor end. Thus, spliced connection 22 permits the transverse spacing between the first and second clamping means to be adjusted to accommodate chain saws having saw bars of different lengths.

The sliding means preferably includes three "sled-like" feet 46, two disposed at the heavier motor end of the frame and one at the opposite nose end of the frame. The feet at the motor end are each welded to the bottom of one leg 12. The foot at the nose end is welded to a short leg secured to the mid-section of one of the longitudinal support members 16. Thus, the feet provide a tripod base for the frame which is not subject to rocking, as often happens with a four-legged base having one leg shorter than the others.

Figure 5:
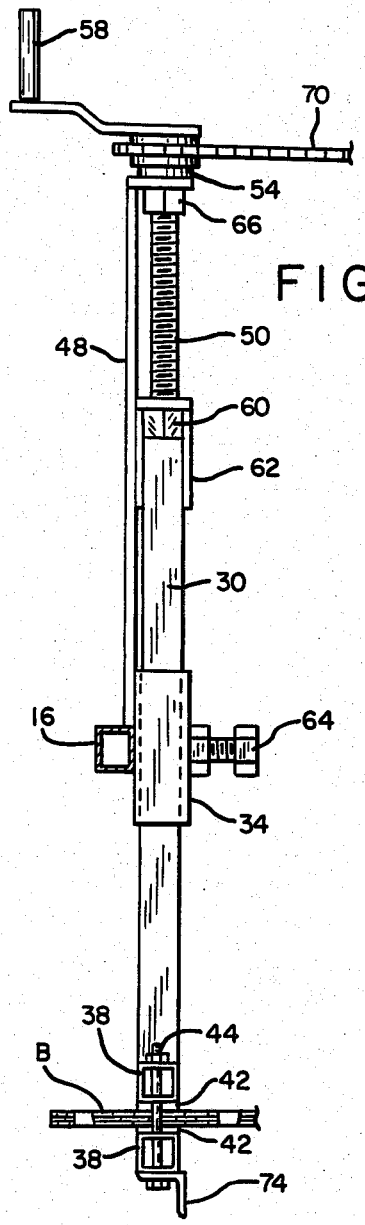
FIG. 5 is an enlarged partly sectional view taken along line 5—5 of FIG. 4.
Figure 6:
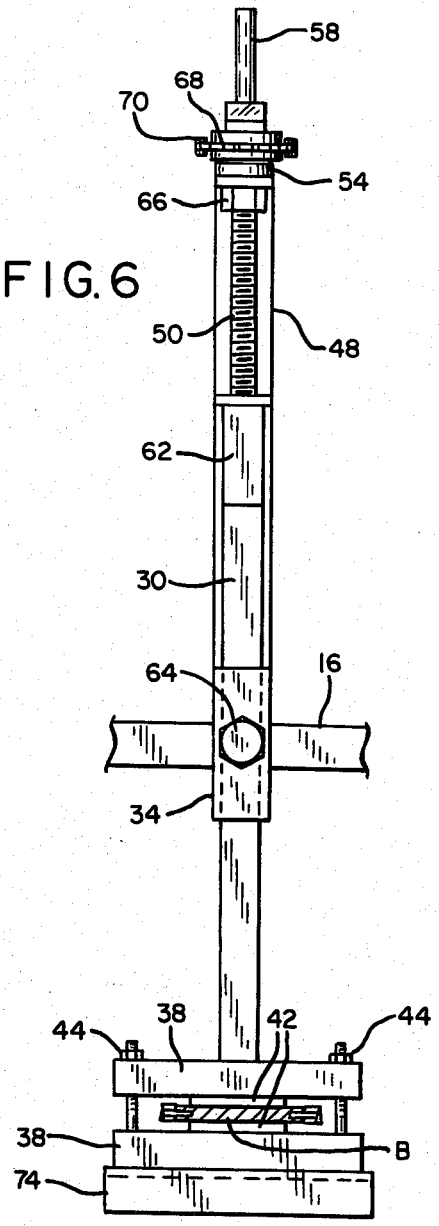
FIG. 6 is an enlarged elevation view taken along line 6—6 of FIG. 5.

The height adjusting means is comprised of two distinct operable portions, one associated with the first clamping means and the other with the second clamping means, which are mirror images of one another. Referring particularly to FIGS. 5 and 6, the portion associated with, for example, the first clamping means includes a support brace 48 welded to the frame, threaded rod 50, collar 54, crank 58 and guide nut 60. Rod 50 is supported by brace 48 and collar 54 for rotation with crank 58. The rod threadably engages nut 60 which is secured rigidly and coaxially to an upper end portion of chain saw support member 30. It extends down into the bore of the support member. Rotation of the crank causes nut 60 and hence the chain saw support member to move upwardly or downwardly on the threaded rod, depending upon the direction of rotation of the crank. This in turn causes the gripped portion of the chain saw to move upwardly or downwardly.

A U-shaped guide bar 62 is welded to an upper portion of the chain saw support member to limit the downward travel of such support member by engagement with guide sleeve 34. Also, it abuts nut 60 to prevent such nut from rotating relative to the chain saw support member. Thus, rotation of rod 50 causes only linear movement of the nut and chain saw support member.

Once both chain saw support members are adjusted to position the chain saw's cutting plane at the desired level, a pair of locking bolts 64 and locking nuts 66 are tightened to lock the support members in place.

The leveling means includes a pair of chain sprockets 68, one mounted for rotation with each threaded rod, and a drive chain 70 interconnecting the two sprockets. The sprockets are sized and toothed such that rotation of either crank 58 causes both threaded rods to rotate simultaneously the same amount, thereby raising or lowering both gripped portions of the chain saw by the same amount.

A guide flange 74 is preferably fastened to each lowermost clamping bar 38 to provide a guide for engagement with a square edge of the log, thereby to minimize transverse movement of the carriage as it slides lengthwise of the log.

Operation

In operation, a felled log is positioned on a substantially flat log supporting surface. It is secured against rolling by a simple jig 78 or similar means. The width of the chain saw carriage is adjusted at the spliced connection as necessary to suit the size of the chain saw. Bolts 44 are tightened to rigidly secure the chain saw in place. The carriage is then aligned longitudinally with the log at one end. One crank is rotated to adjust the level of the saw chain and hence its cutting plane relative to the log, as desired.

Typically, for a preliminary cut, the saw bar is positioned substantially parallel to the ground and at a level just below the log's upper surface such that the chain saw cuts away an outer slab. The cut is made as an operator pushes the frame the length of the log, after which the log has one flat, smooth surface. The log can then be rotated 180° such that the flat surface is in contact with the ground and a similar outer slab removed from the log's opposite surface. A jig is not necessary for this cut since the flat surface of the first cut will support the log against rolling. After the second cut, the process is repeated for the other two sides of the log.

Once the log has been "squared-up", the log can be cut into boards, beams, etc. of desired size simply by rotating the log and adjusting the level of the cut to the desired thickness as desired. For portable on-site chain saw mills, the present chain saw carriage is believed to be uniquely capable of cutting boards as thin as about ¼ inch and cutting logs having diameters as small as about six inches.

During the cutting operation, standard chain saw operating procedure makes it desirable for the leading (cutting) edge of the chain saw to be the edge along which the saw chain moves toward the motor.

Beveled cuts can be made by elevating one side of the chain saw carriage relative to the other. This is most easily accomplished by laying a board or other elevating flat support surface along one side of the log such that the frame is tilted with reference to the log supporting surface. Thus, the cutting plane of the saw chain is disposed angularly relative to the log supporting surface, enabling the chain saw to, for example, cut away a corner portion of a squared-up log.

It will be appreciated that for each and every cut the cutting plane of the chain saw is made with reference to the frame supporting surface (which typically forms a common plane with the log supporting surface). Thus, any cutting inaccuracies, such as undulations, in a particular cut will not affect the accuracy of successive cuts, since the log's upper surface is not relied upon as a guide reference. Of course, it is important that the frame supporting surface be as close to perfectly flat as possible.

Because the weight of the carriage and chain saw is not supported by the log's upper surface, such weight does not exacerbate any tendency of the saw chain to bind during cutting. The only "pinching" force exerted on the saw chain is the weight of the overhead slab being cut.

It will be appreciated that the present invention facilitates the making of accurate cuts in the log even though the log and frame supporting surface may be inclined, so long as it is flat.

Unlike most prior chain saw attachments, it is not necessary to nail a board to the log's outer surface for outer slab cuts or thereafter remove the board from the removed outer slab. Thus, present chain saw carriage promotes efficient, reduced cost cutting operations.

Finally, it will be appreciated that the present invention has a relatively light, simple construction that promotes accurate cutting. It is compact and can be easily adjusted to accommodate chain saws of different sizes. And, most importantly, it can be used easily and accurately by one person.

Having illustrated and described the principles of my invention with reference to one preferred embodiment, it should be apparent to those persons skilled in the art that such invention may be modified in arrangement and detail without departing from such principles. I claim as my invention all such modifications as come within the true spirit and scope of the following claims.

1. A portable chain saw attachment for a chain saw to facilitate cutting a reclined log into lumber, the log being supported by a substantially planar log supporting surface, the chain saw having a saw chain, saw bar, motor end and opposite nose bar end, the attachment comprising:

frame means having interconnected frame members for straddling the log without contacting the log;

a plurality of sliding members mounted to said frame for direct contact with said supporting surface such that said frame can slide on said supporting surface relative to said log, said sliding members having substantially planar bottom portions;

mounting means for mounting the chain saw such that said saw chain defines an imaginary cutting plane disposed at a predetermined relationship to said log supporting surface;

height adjusting means interconnecting said frame means and mounting means for adjusting the height of said mounting means relative to said log supporting surface;

said frame means including a plurality of substantially vertical support members and horizontal support means supportively interconnecting said vertical members;

said horizontal support means including opposed pairs of telescoping support members adjustable to vary the width of said frame means and thereby accommodate saw bars of different lengths;

said mounting means including first clamping means for clamping said nose bar end and second clamping means for clamping said motor end;

said height adjusting means including a pair of rotatable threaded elements, one associated with each said first and second clamping means, and a pair of vertically movable support elements, one connected to each said first and second clamping means, each said movable support element being threadably engaged by one said threaded element such that rotation of said threaded element causes its associated said support element and clamping means to move upwardly or downwardly; and said height adjusting means further including a drive chain cooperable with said threaded support elements for translating rotation of one said threaded element into simultaneous corresponding rotation of the other said threaded element.

2. The chain saw attachment of claim 1 wherein said plurality of sliding members comprises first and second sliding members mounted to the frame for longitudinal sliding movement along one side of said log, and a third sliding member mountd to the frame for longitudinal sliding movement along the other side of said log.

3. The chain saw attachment of claim 2 wherein said frame is comprised of a motor end supporting portion for supporting said motor end of said chain saw and a nose end supporting portion for supporting said nose end of said chain saw, said first and second sliding members being mounted in supporting relationship to said frame beneath said motor end supporting portion, said third supporting member being mounted in supporting relationship to said frame beneath said nose end supporting portion.

4. The chain saw attachment of claim 1 wherein said planar surface comprises the ground.

* * * * *